US007652868B2

(12) United States Patent
Gaudinat et al.

(10) Patent No.: US 7,652,868 B2
(45) Date of Patent: Jan. 26, 2010

(54) ELECTROPYROTECHNIC INITIATOR

(75) Inventors: François Gaudinat, Amblainville (FR); Yann Le Gallic, Chanteloup en Brie (FR)

(73) Assignee: Autoliv Development AB, Vargarda (SE)

( * ) Notice: Subject to any disclaimer, the term of this patent is extended or adjusted under 35 U.S.C. 154(b) by 491 days.

(21) Appl. No.: 11/662,990

(22) PCT Filed: Aug. 4, 2005

(86) PCT No.: PCT/EP2005/053847

§ 371 (c)(1),
(2), (4) Date: Mar. 15, 2007

(87) PCT Pub. No.: WO2006/032573

PCT Pub. Date: Mar. 30, 2006

(65) Prior Publication Data

US 2008/0072748 A1 Mar. 27, 2008

(30) Foreign Application Priority Data

Sep. 21, 2004 (FR) ..... 04 09953

(51) Int. Cl.
*B60R 21/00* (2006.01)

(52) U.S. Cl. ..... 361/264

(58) Field of Classification Search ..... 361/264
See application file for complete search history.

(56) References Cited

U.S. PATENT DOCUMENTS 4,061,088 A 12/1977 Euda et al.
4,103,619 A 8/1978 Fletcher et al.
4,306,499 A * 12/1981 Holmes ..... 102/202.4
5,672,841 A * 9/1997 Monk et al. ..... 102/202.4
5,847,309 A 12/1998 Baginski et al.
5,905,226 A 5/1999 Baginski et al.
6,054,760 A 4/2000 Martinez-Tovar et al.
6,192,802 B1 2/2001 Baginski et al.
6,272,965 B1 8/2001 Baginski et al.
6,408,758 B1 * 6/2002 Duguet ..... 102/202.2
6,526,890 B1 * 3/2003 Vidot et al. ..... 102/202.12
6,601,514 B1 8/2003 Bretfeld et al.
2003/0213395 A1 11/2003 Baldensperger

FOREIGN PATENT DOCUMENTS

EP 1 364 844 A 11/2003
GB 2 315 118 A 1/1998

* cited by examiner

*Primary Examiner*—Stephen W Jackson
(74) *Attorney, Agent, or Firm*—Harness, Dickey & Pierce, P.L.C.

(57) ABSTRACT

The invention relates to an electropyrotechnic initiator whose circuit board (15) supports on a first face (18) a resistance element (21) for heating a pyrotechnic charge (22, 23). According to the invention, the second face (19) of the circuit board (15), opposite the first face (18), supports means (30) of protection against the electrostatic discharges, housed between the two electrodes (10, 11) powering the element (21) in a recess (91) of an insulating structure (9) through which the electrodes (10, 11) pass.

9 Claims, 3 Drawing Sheets

ELECTROPYROTECHNIC INITIATOR

Figure 1:
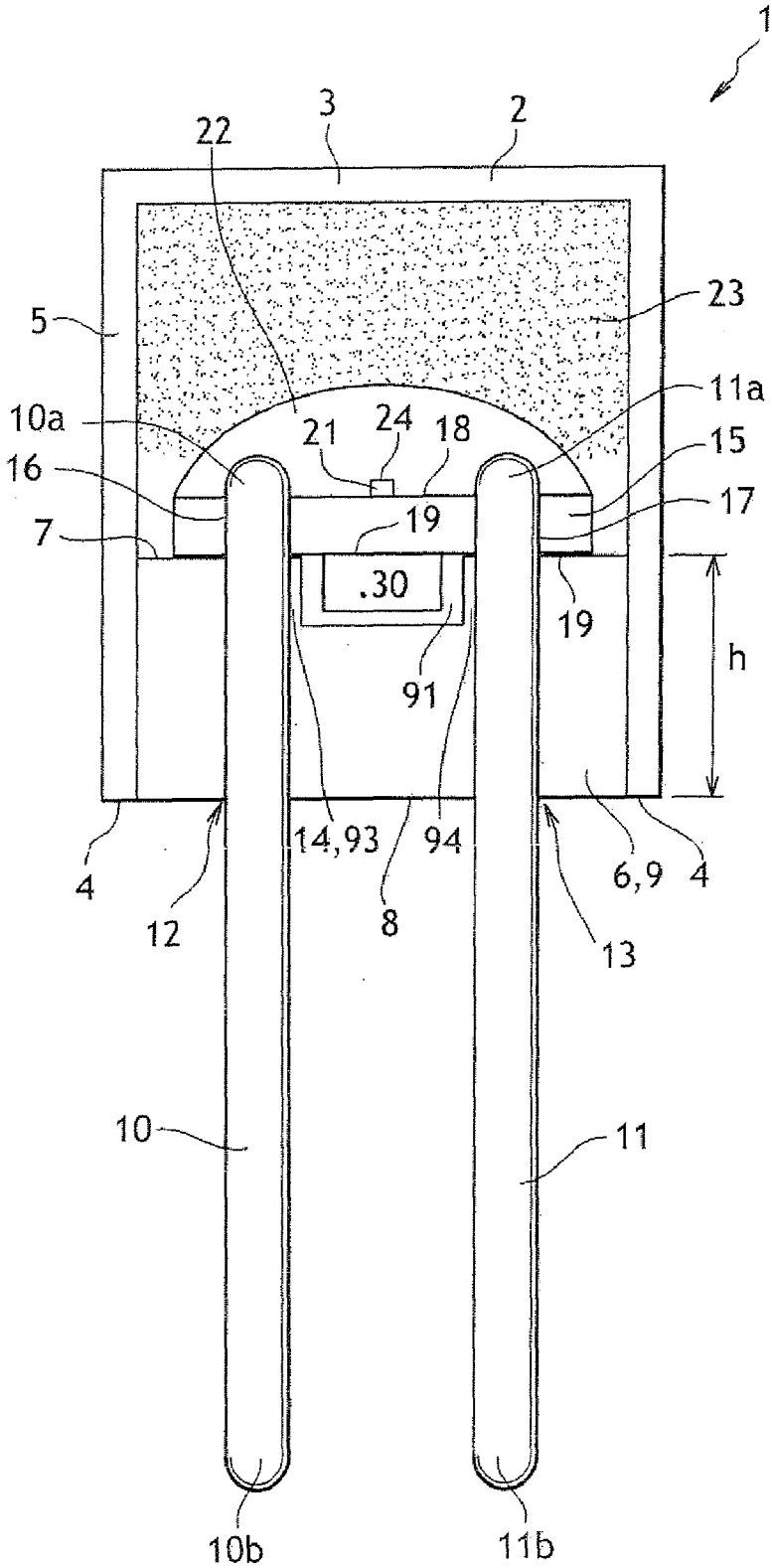

The invention relates to an electropyrotechnic initiator.

One field of application of the invention concerns initiators for igniting the pyrotechnic charges of gas generators intended to activate devices to protect the occupants of automobile vehicles, such as for example airbags.

The electric circuit present in the initiator usually comprises a heating element to ignite a pyrotechnic charge covering it.

Document U.S. Pat. No. 6,166,452 describes an example of an electropyrotechnic initiator whose circuit comprises a 2.2 μF capacitor for storing the energy necessary to pass the charge ignition current into the heating element. A controller formed by an application-specific integrated circuit (ASIC) is connected to the two electrodes of the initiator to receive from an external control unit (ECU) a digital activation command which will cause switches of the controller to discharge the energy of the storage capacitor into the heating element. The controller is furnished with a 0.1 μF decoupling capacitor, the storage capacitor and two varistors, for protection against the electrostatic discharges, connected between the case of the initiator and the two controller terminals connected to the two electrodes, on a first face of a circuit board, while the other second face of this board is that which supports the heating element and two 110Ω resistors linking the two electrodes to the controller, a 75 kΩ resistor for setting a controller diagnostic current, and interconnection holes providing the electrical links between the two faces.

This initiator is assembled as follows.

The first face of the circuit board delimits with a metal disc and a metal ring a first chamber which is filled by injection with an epoxy material. An elastomer washer is then placed against the second face, then a tubular metal element is placed around the circuit board, the ring and the disc, and is attached to the latter. A pyrotechnic, powdery or granular material is then tamped into the second chamber defined by the tubular metal element with a force of 680 atmospheres against the second face supporting the heating element, while the epoxy material of the first chamber supports the circuit board against this force, to prevent the board being damaged. Finally, the open end of the tubular metal element is sealed.

This initiator has the advantage of providing many communication and diagnostic functionalities thanks to the controller, but the greater the number of constituent parts, the more vulnerable it is to defects.

Furthermore, the large number of its constituent parts complicates and increases the cost of its fabrication and its assembly on a mass production line.

This initiator is also extremely bulky, which is incompatible with the miniaturization and lightness requirements imposed in the automobile sector, including on the devices for occupant protection.

One of the means of reducing the number of constituent parts of the initiator is naturally to set aside the preceding initiator and to return to a simpler circuit, no longer comprising a controller which is the circuit component taking up the most space, and comprising essentially the heating element.

Such a circuit is for example known through document FR-A-2 784 176 and through document EP-A-1 030 159. However, in these two cases, it is the varistor, protecting the initiator against the electrostatic discharges connected to the two electrodes, that takes up more space than the heating element on the circuit in contact with the pyrotechnic material.

The invention aims to obtain a reliable electropyrotechnic initiator alleviating the disadvantages of the state of the art, while allowing a simple assembly, taking up as little space as possible, while having both a resistance heating element and an element for protection against the electrostatic discharges.

As a result, a first subject of the invention is an electropyrotechnic initiator comprising:

- a cap enclosing a pyrotechnic charge,
- an insulating printed circuit board comprising a first face on which there is a resistance element for heating the pyrotechnic charge, covered by the latter, and a second face opposite the first face,
- a first electrode and a second electrode powering the resistance heating element,
- a support of the second face of the insulating printed circuit board, this support closing the cap and comprising an insulating structure through which the two electrodes pass, characterized in that the initiator also comprises means of protection against the electrostatic discharges, whose first terminal is connected to the first electrode and whose second terminal is connected to the second electrode, the means of protection against the electrostatic discharges are attached to the second face and are situated at least partially in the zone comprised between the first and second electrodes, a recess of predetermined shape for housing the means of protection against the electrostatic discharges being made in the insulating structure extending between the first electrode and the second electrode and around the electrodes.

Thanks to the invention, the zone lying between the two electrodes is used to house the protection means, which makes it possible to reduce the bulk of the circuit. The invention enables to obtain an optimized disposition of its different constituent parts, taking up clearly less space than the initiators of the state of the art.

In comparison with a conventional structure, as according to document EP-A-1 030 159, this disposition of the protection means requires a removal of material in the insulating structure to create the recess, which does not add additional constituent parts to the initiator and enables to lighten it still further.

Thus, the invention avoids having to inject an epoxy material as in document U.S. Pat. No. 6,166,452, while holding the printed circuit board with fewer constituent parts. Specifically, in document U.S. Pat. No. 6,166,452, the shape of the filling of epoxy material beneath the varistors can be determined only by matching the shapes of the components (controller, decoupling capacitor, storage capacitor, varistors) of their face and is not predetermined, hence inevitable disparities from one initiator to the other. On the contrary, the protection means according to the invention are not touched by the insulating structure and the recess has a predetermined shape. The assembly of the initiator according to the invention is thus rendered more precise and more simple.

Furthermore, the recess is used to protect the protection means themselves against the attacks and to dissipate outside the pyrotechnic charge the heat generated by the electrostatic discharges in these means, thus diminishing the risks of unintentional ignition of the charge.

The fact that according to a feature of the invention, the electric circuit supported by the circuit board comprises only the heating element and the means of protection against the electrostatic discharges makes it possible to reserve the whole volume of the cap for the pyrotechnic material. Furthermore if according to a feature of the invention, the pyrotechnic charge is centred on the heating element, a more homogeneous firing of the pyrotechnic charge is obtained which will not be hampered by the protection means or by other components of the face supporting the heating element.

According to other characteristics of the invention, the means of protection against the electrostatic discharges comprise a fixedly attached component, and the second face of the circuit board comprises first and second electrically conducting soldering pads that are connected to the first and second electrodes and onto which the first and second terminals of the component are soldered by an electrically conducting material;

the resistance heating element is formed by the central portion of at least one electrically conducting layer photoengraved on the first face of the circuit board, the said layer of the first face of the circuit board comprising, connected on either side to the central portion, first and second end portions covered respectively by at least first and second contact pads with the first electrode and second electrode, at least one hole for electric connection between the first soldering pad and the first contact pad and at least one hole for electric connection between the second soldering pad and the second contact pad being provided through the circuit board;

the means of protection against the electrostatic discharges comprise at least one varistor.

Figure 2:
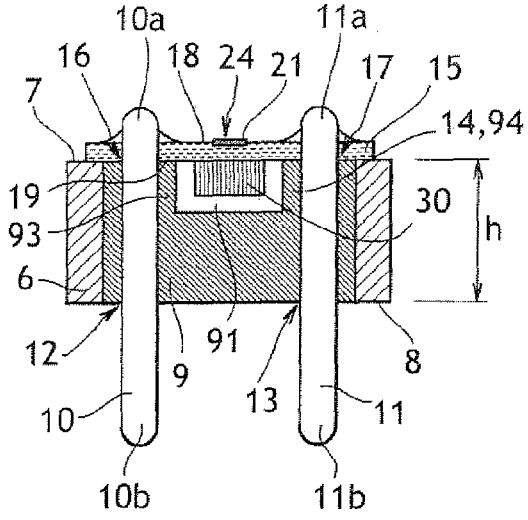
Figure 3:
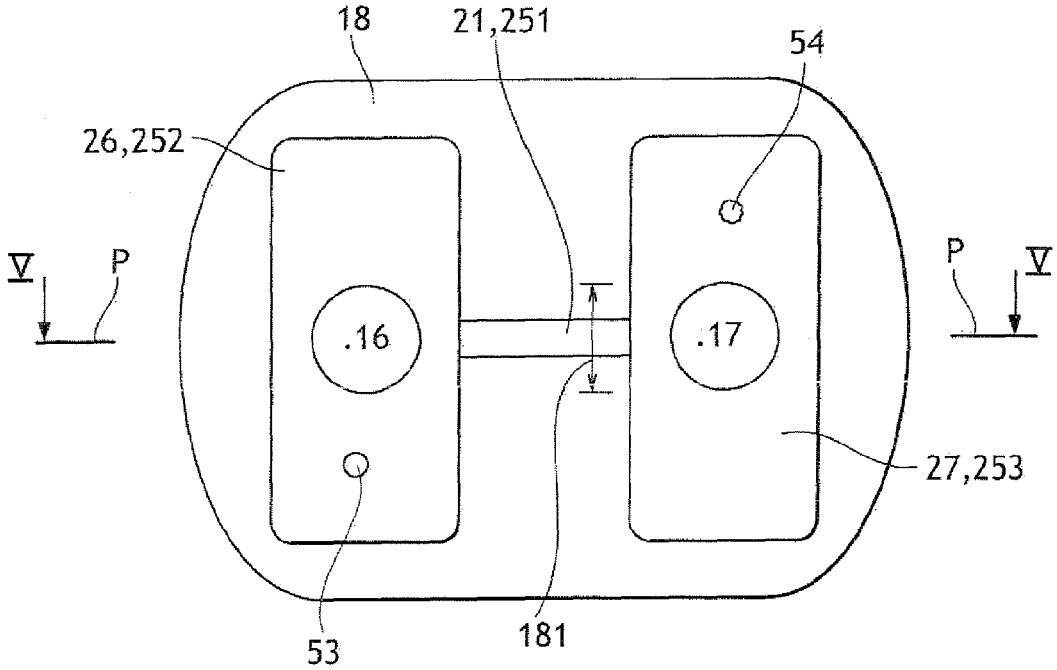
Figure 5:
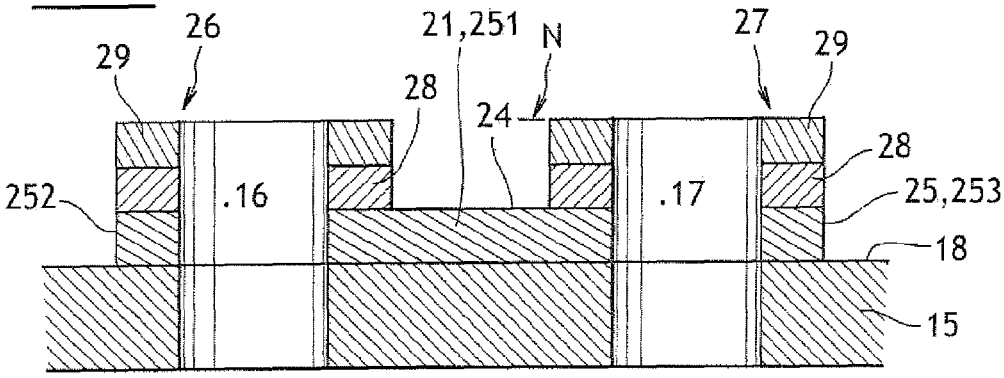
Figure 4:
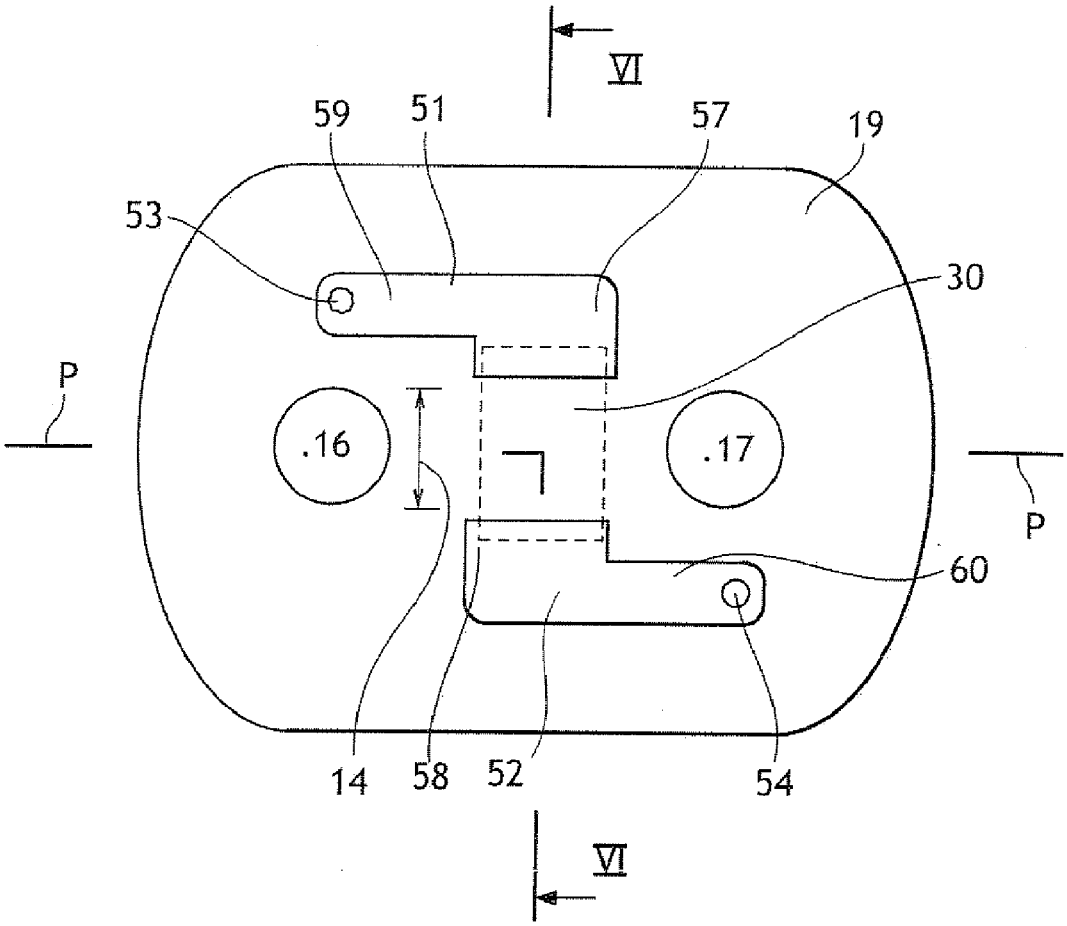
Figure 6:
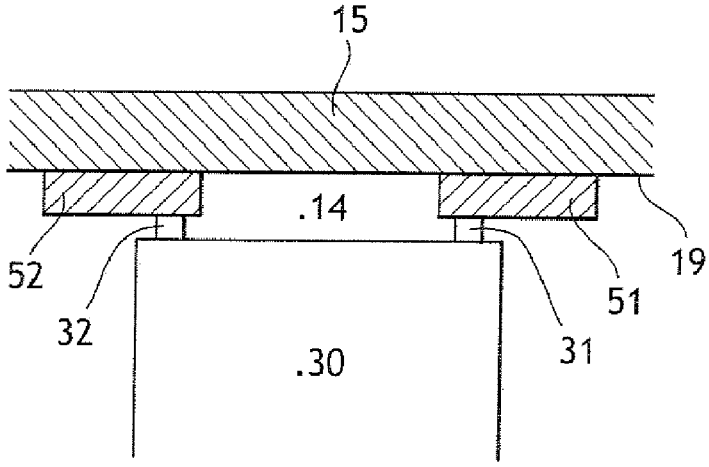

The invention will be better understood on reading the description that follows, given only as a non-limiting example with reference to the appended drawings, in which:

FIG. 1 represents schematically in cross, vertical and axial section a first embodiment of the initiator according to the invention, FIG. 2 represents schematically in cross, vertical and axial section a second embodiment of the initiator according to the invention, in which the cap and the pyrotechnic charge according to FIG. 1 are not shown, FIG. 3 represents schematically in top view a possible embodiment of the circuit board of the initiator of FIGS. 1 and 2, furnished with its various layers, FIG. 4 represents schematically in bottom view the embodiment of the circuit board of the initiator according to FIG. 3, furnished with its various layers, FIG. 5 represents schematically in cross section, along the line V-V of the transverse plane P of FIG. 3, the top face of the circuit board, the components present on the bottom face not being shown; and FIG. 6 represents schematically in cross section, along the line V-V of FIG. 4, perpendicular to the sectional plane of FIG. 5, the bottom face of the circuit board, the components present on the top face not being shown.

In FIGS. 1 and 2, the initiator 1 comprises a cap or container 2, for example circular cylindrical about the vertical axis of the initiator. This cap 2 is fragmentable on its top surface 3 and is open at the end 4 of its lateral wall 5, farthest from the top face 3. A body 6, for example circular cylindrical, closes off the open end 4 of the cap 2 and is attached by any appropriate means to its lateral wall 5, for example only inside the latter as is shown in FIG. 1. Naturally, the body 6 could equally enclose the outside of the wall 5, in other embodiments not shown. In addition, the cap could also contain an inner metal tube against its lateral wall 5, in order to reinforce the latter. The cap 2 is made of a fine light metal, such as aluminium, and its top face 3 is for example weakened so that it is able to open easily under the effect of an increase in pressure existing inside the cap.

The body 6 has a top face 7 and a bottom face 8, both plane for example, and encloses, throughout its entire height h between its faces 7 and 8, a sealed structure or through-hole 9, electrically insulating for two electrically conducting electrodes 10, 11 to pass through in two holes 12, 13 traversing the structure and emerging in the top face 7 and bottom face 8. This insulating structure 9 for the two electrodes 10, 11 to pass through is for example vitreous. The two electrodes 10, 11 are for example each in the shape of a longitudinal and vertical pin. The insulating structure 9 extends around the electrodes 10, 11 and in the zone 14 lying between the electrodes, comprising in particular the volume delimited by the thickness of the electrodes 10, 11 at least close to the top face 7 and for example throughout the entire height h.

In the embodiment shown in FIG. 1, the body 6 is electrically insulating, being for example made of glass, and itself forms the structure 9 for the two electrodes 10, 11, to pass through, while directly enclosing the electrodes 10, 11 in the through-holes 12, 13.

In the embodiment shown in FIG. 2, the structure 9 for the two electrodes to pass through is formed by a single tube distinct from the body 6, the body 6 being annular and laterally surrounding the tube 9 attached in the body, the tube 9 and the body 6 being for example circular cylindrical. The body 6 is for example made in this case of a dense metal, such as steel.

According to the invention, the body 6 and/or the insulating structure 9 serves (serve) as support for a printed circuit board 15 and is (are) called a support 6 hereinafter, the circuit board 15 being entirely on the insulating body 6 in the embodiment shown in FIG. 1, or having one portion on the body 6 and another portion on the structure 9 in the embodiment shown in FIG. 2. The bottom face 19 of the circuit board 15 is against the top face 7.

In the exemplary embodiments shown in the figures, the circuit board 15 is insulated from the electrodes 10, 11, is made of electrically insulating material and is made of a glass-resin mixture, such as a composite polymer of the glass fibre-filled epoxy type. Two cylindrical through-channels 16 and 17 are provided in the circuit board 15 for the electrodes 10 and 11 to pass through between its first and second top and bottom faces 18, 19. Each electrode 10 and 11 exhibits respectively a top end 10*a*, 11*a*, which protrudes from the top face 7 of the insulating structure 9 and of the support 6, and from the first top face 18 of the circuit board 15, and a bottom end 10*b*, 11*b* which protrudes from the bottom face 8 of the insulating structure 9 and of the support 6.

The circuit board 15 supports an electric circuit 20 which comprises on its top face 18 a resistance heating element 21 which is electrically connected between the electrodes 10, 11, this element 21 therefore being suitable for conducting an electric current between its two ends connected respectively to the two electrodes 10, 11. The resistance element 21 is made in a manner known per se, the layers present on the top face 18 to constitute the element 21 being able for example to have the shape of those of the patent application published under number FR-A-2 800 865 instead of that shown in the figures.

The resistance element 21 has a top surface 24 which is covered by a pyrotechnic charge contained in the cap 2, intended to be ignited by the element 21. This pyrotechnic charge comprises for example a pyrotechnic priming composition 22, which is in contact with the resistance heating element 21 and which is for example based on lead trinitroresorcinate, and an ignition powder or composition 23, which covers the priming pyrotechnic composition 22 and which consists, for example, of a nitrocellulose-based powder or a mixture of boron and potassium nitrate. The resistance heating element 21 is for example flat. The priming pyrotechnic composition 22 could also be a mixture of zirconium and potassium perchlorate and the ignition powder 23 a mixture of titanium hydride and potassium perchlorate. Thus, when a sufficient current corresponding to a Uf operating voltage between the electrodes 10, 11 is sent by these electrodes, this current passing through the resistance element 21 will heat up by Joule effect the resistance of the element 21. Heat produced by the resistance element 21 will then ignite the charge 22, then the charge 23.

According to the invention, the electric circuit 20 also comprises a varistor 30 protecting the resistance heating element 21 against the electrostatic discharges, this varistor being therefore connected electrically in parallel by its two first and second terminals 31, 32 with the heating element 21 between the two electrodes 10, 11. The varistor 30 exhibits, for low voltages between its terminals, equal to or less than the Uf operating voltage of the heating element 21, an equivalent resistance high in view of the resistance of the element 21, so that the current passes for the most part in this case into the element 21, whereas for voltages between the terminals of the varistor, greater than a predetermined value U0 greater than the operating voltage Uf, the equivalent resistance of the varistor 30 is less than the resistance of the element 21, so that the electrostatic discharges between the electrodes 10, 11 are diverted into the varistor 30.

According to the invention, the varistor 30 could be replaced by any other circuit or means 30 of protection against the electrostatic discharges, aiming either to dissipate the electric energy of the electrostatic discharge, or to store it, or to spread the energy of the electrostatic discharge over time. In this last case, use could be made of a capacitor in these protection means. Given that the means 30 are connected between the electrodes 10, 11, they must for example be able to support high peaks of current due to the electrostatic discharges and therefore exhibit for example a three-dimensional volume and therefore a considerable thickness relative to the thicknesses of the printed circuit pads of the circuit board 15. In the embodiment shown in the figures, the means 30 of protection against the electrostatic discharges take the form of a varistor 30, it being understood that the term "varistor 30" may be replaced by "means 30 of protection against the electrostatic discharges".

The protection varistor 30 is provided on the bottom face 19 of the circuit board 15. The insulating structure 9 comprises for this purpose a recess 91 for housing the varistor 30, which is for example a varistor component fixedly attached to the bottom face 19. There exists therefore in the recess 91 a volume of gas, for example of air, delimited between the insulating structure 9 and the bottom face 19, in order to allow for example the dissipation of energy through the means 30 of protection against the electrostatic discharges, situated in this volume. For example, in assembly position, the varistor 30, and more generally the means 30 of protection against the electrostatic discharges, may be at a distance from the insulating structure 9 and from its portions delimiting the recess 91. In this case, there may be an interstice between the means 30 and the insulating structure 9, for example as a functional clearance. However, the means 30 could also touch the insulating structure 9.

The recess 91 has a predetermined shape, for example circular cylindrical with a bottom 92 being plane and parallel to the faces 7, 19. The recess 91 is made in the insulating structure 9 for example by preforming or moulding.

The recess 91 and the varistor 30 therein are placed in the zone 14 of the face 7 of the insulating structure 9, lying between the electrodes 10 and 11. Naturally, depending on the size of the varistor 30, the recess 91 and the varistor 30 therein may protrude from this zone 14, as is shown for example in FIG. 4. The insulating structure 9 comprises intermediate portions 93 and 94 respectively between the electrode 10, 11 and the varistor 30. On the top face 18 of the circuit board 15, the heating element 21 is also situated in the zone 181 lying between the electrodes 10, 11, comprising in particular the space delimited by the thickness of the electrodes 10, 11, as is shown for example in FIG. 3. These zones 181 and 14, being in the centre of the two faces 18, 19 of the circuit board 15, enable to reduce the bulk relating to the varistor 30 while situating the heating element 21 substantially in the middle of the pyrotechnic charge 22, 23, without being hampered by the varistor 30 when this charge 22, 23 is ignited by the heating element 21. The result is a compact structure, when the electric circuit 20 comprises only the heating element 21 and the varistor 30 connected in parallel between the electrodes 10, 11.

On the top face 18 in FIGS. 3, 5 and 6, the resistance heating element 21 is metallic and is formed for example by the central portion 251 of an electrically conducting layer 25, for example made of a nickel-chrome alloy. With the exception of its central portion forming the resistance heating element 21, two first and second end portions 252, 253 of the layer 25, each extending on one side the central portion 251, are covered by two first and second separate electric contact pads 26, 27 contacting respectively the two electrodes 10, 11. The contact pads 26, 27 are covered by the pyrotechnic charge 22, and each comprise for example a layer 28 made of a first electrically conducting material, for example copper, on the layer 25. This layer 28 is for example covered by another electrically conducting layer 29, for example made of tin. The layer 25 and the contacts 26, 27 on the outside of the heating element 21 are traversed by the electrodes 12 and 13.

In addition, when the initiator is fabricated so that the pyrotechnic charge 22 is in physical contact with the heating element 21 or is bonded thereto, the initiator allows to detect any physical contact defects or separations between the latter, when the electric circuit supported by the circuit board 15 comprises only the heating element 21 on the top face 18 or when no metal element is above the top level N of the contact pads 26, 27 and above the element 21. Such defects are for example detected by the presence of an air bubble between this heating element and the pyrotechnic charge, and this air bubble can be above the top level N of the pads 26, 27. The detection method uses for example an X-ray check between the pads 26, 27 above the element 21 or above the top level N of the pads 26, 27 in a direction passing through the plane P of the electrodes 10, 11, and for example perpendicular to this plane P, between the electrodes 10, 11 and above the element 21.

On the bottom face 19 of the circuit board 15 in FIGS. 4 and 6 are provided first and second contact pads 51, 52 of the first and second terminals 31, 32 of the varistor 30 with the electrodes 10, 11.

These contact pads 51, 52 are for example provided on either side of the plane P joining the electrodes 10, 11 and the zones 14 and 181. The two pads 51, 52 comprise respectively two portions 57, 58 adjacent to the zone 14 for the reception of the terminals 31, 32 of the varistor 30, these two portions 57, 58 being connected to two portions 59, 60 of electrical connection with the electrodes 10, 11.

The electric connection between the electrodes 10, 11 and the pads 51, 52 is provided for example by metallized holes 53, 54 passing through the circuit board 15 and joining respectively the portion 59 of the pad 51 to the pad 26 and the portion 60 of the pad 52 to the pad 27. Two holes 53 may be provided in the circuit board 51 and the pad 26, and two holes 54 may be provided in the pad 52 and the pad 27.

The invention claimed is:

1. Electropyrotechnic initiator comprising:

a cap enclosing a pyrotechnic charge, an insulating printed circuit board comprising a first face on which there is a resistance element for heating the pyrotechnic charge, covered by the latter, and a second face opposite the first face, a first electrode and a second electrode for powering the resistance heating element, a support of the second face of the insulating printed circuit board, this support closing the cap and comprising an insulating structure through which the two electrodes pass, wherein the initiator also comprises means of protection against the electrostatic discharges, whose first terminal is connected to the first electrode and whose second terminal is connected to the second electrode, the means of protection against the electrostatic discharges are attached to the second face and are situated at least partially in the zone lying between the first electrode and second electrode, a recess of predetermined shape for housing the means of protection against the electrostatic discharges is made in the insulating structure extending between the first electrode and the second electrode and around the electrodes.

2. Electropyrotechnic initiator according to claim 1, wherein the electric circuit supported by the circuit board comprises only the heating element and the means of protection against the electrostatic discharges.

3. Electropyrotechnic initiator according to claim 1, wherein the means of protection against the electrostatic discharges comprise a fixedly attached component, and the second face of the circuit board comprises first and second electrically conducting soldering pads that are connected to the first and second electrodes and onto which the first and second terminals of the component are soldered by an electrically conducting material.

4. Electropyrotechnic initiator according to claim 3, wherein the resistance heating element is formed by the central portion of at least one electrically conducting layer photoengraved on the first face of the circuit board, the said layer of the first face of the circuit board comprising, connected on either side to the central portion, two first and second end portions covered respectively by at least first and second contact pads contacting the first electrode and second electrode, at least one hole for electric connection between the first soldering pad and the first contact pad and at least one hole for electric connection between the second soldering pad and the second contact pad are provided through the circuit board.

5. Electropyrotechnic initiator according to claim 1, wherein the means of protection against the electrostatic discharges comprise at least one varistor.

6. Electropyrotechnic initiator according to claim 2, wherein the means of protection against the electrostatic discharges comprise a fixedly attached component, and the second face of the circuit board comprises first and second electrically conducting soldering pads that are connected to the first and second electrodes and onto which the first and second terminals of the component are soldered by an electrically conducting material.

7. Electropyrotechnic initiator according to claim 2, wherein the means of protection against the electrostatic discharges comprise at least one varistor.

8. Electropyrotechnic initiator according to claim 3, wherein the means of protection against the electrostatic discharges comprise at least one varistor.

9. Electropyrotechnic initiator according to claim 4, wherein the means of protection against the electrostatic discharges comprise at least one varistor.

* * * * *